US010562172B1

(12) United States Patent
Armstrong

(10) Patent No.: US 10,562,172 B1
(45) Date of Patent: Feb. 18, 2020

(54) POLE APPARATUS

(71) Applicant: Blue Point Fasteners, Chino, CA (US)

(72) Inventor: William D. Armstrong, Chino, CA (US)

(73) Assignee: BLUE POINT FASTENERS, Chino, CA (US)

( * ) Notice: Subject to any disclaimer, the term of this patent is extended or adjusted under 35 U.S.C. 154(b) by 171 days.

(21) Appl. No.: 15/799,550

(22) Filed: Oct. 31, 2017

Related U.S. Application Data

(60) Provisional application No. 62/415,176, filed on Oct. 31, 2016.

(51) Int. Cl.
*B25G 1/04* (2006.01)
*B25G 3/02* (2006.01)

(52) U.S. Cl.
CPC . *B25G 1/04* (2013.01); *B25G 3/02* (2013.01)

(58) Field of Classification Search
CPC ... B25G 1/00; B25G 1/04; B25G 3/00; B25G 3/02
USPC ..... 16/405, 427, 429, DIG. 41
See application file for complete search history.

(56) References Cited

U.S. PATENT DOCUMENTS 4,325,157 A * 4/1982 Balint ..... B05C 17/0205 15/144.4
4,793,646 A * 12/1988 Michaud, Jr. ..... B63B 21/54 114/221 R
5,220,707 A * 6/1993 Newman, Sr. ..... B05C 17/0205 15/144.4
6,158,089 A * 12/2000 Monahan ..... B25G 1/04 16/405
6,254,305 B1 7/2001 Taylor
6,546,596 B2 * 4/2003 Grote ..... B05C 17/0205 15/143.1
6,786,116 B2 9/2004 Dockery
7,716,790 B2 * 5/2010 Newman, Jr. ..... B25G 3/18 16/422
8,490,250 B2 * 7/2013 Lanz ..... B25G 1/04 16/427
9,009,921 B1 * 4/2015 Ramsey ..... E04D 13/0765 16/429
2003/0135950 A1 * 7/2003 Dove ..... B05C 17/0205 15/230.11
2003/0135955 A1 * 7/2003 Dove ..... B25G 1/04 16/429
2010/0109357 A1 5/2010 Lofley et al.
2010/0278523 A1 11/2010 Brown
(Continued)

FOREIGN PATENT DOCUMENTS

GB 2529432 A 2/2016
WO 2001-06137 A1 1/2001
WO 2010051026 A1 5/2010

*Primary Examiner* — Roberta S Delisle
(74) *Attorney, Agent, or Firm* — Umberg Zipser LLP

(57) ABSTRACT

Various embodiments of pole devices are described having inner and outer poles or segments that allow for telescoping of the pole device. The inner and outer poles can each include one or more flat side wall portions, which act to thereby prevent rotation of the inner and outer poles with respect to each other. Each of the inner and outer poles can include one or more apertures that are sized to receive a pin to thereby couple the inner and outer poles. One or more gaps may be formed between the inner and outer poles that is sized to receive a burr of at least one of the inner or outer pole.

17 Claims, 7 Drawing Sheets

(56) References Cited

U.S. PATENT DOCUMENTS

| | | | | |
|---|---|---|---|---|
| 2011/0101716 | A1* | 5/2011 | Nolte | B25G 1/04<br>294/174 |
| 2013/0333527 | A1 | 12/2013 | Su | |
| 2013/0333528 | A1 | 12/2013 | Su | |
| 2015/0128771 | A1 | 5/2015 | Lofley et al. | |

* cited by examiner

POLE APPARATUS

This application claims priority to U.S. provisional application Ser. No. 62/415,176 filed on Oct. 31, 2016. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is a pole apparatus, and more specifically, a pole apparatus that can be used for installing equipment onto a ceiling.

BACKGROUND

The background description includes information that may be useful in understanding the present invention. It is not an admission that any of the information provided herein is prior art or relevant to the presently claimed invention, or that any publication specifically or implicitly referenced is prior art.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Pole devices have been used as a tool to aid users working in hard to reach areas. For example, a telescopic pole can be used to assist users in installing equipment onto a ceiling. Advantageously, safety of the users is increased by eliminating the need for a scaffold, stilts, a bench, or a scissor lift to reach the ceiling to install equipment.

U.S. Pat. No. 6,786,116 to Dockery discloses a pole apparatus having at least two telescopic body sections. The pole apparatus can be configured into a collapsed orientation and a telescoped orientation by inserting a pin through bores disposed on the two body sections of the pole apparatus. Although the pole apparatus of Dockery and other pole devices (e.g., Ninja™ fastening tool by BluePoint® Fasteners) are useful for certain applications, the lifespan of many pole devices can be problematic due to common failures (e.g., bowing, burring, etc.) observed in such devices.

Thus, there is still a need in the art for improved pole devices that reduce the risk of common failures.

SUMMARY OF THE INVENTION

The inventive subject matter provides apparatus, systems, and methods in which common failures (e.g., bowing, burring, etc.) associated with conventional pole devices are substantially reduced. More particularly, bowing and/or burring of apertures disposed on the body of a pole apparatus are reduced over conventional pole devices. In a contemplated embodiment, a pole apparatus comprises an inner pole at least partially disposed within a middle pole. The inner pole comprises a first recess disposed on an outer sidewall. The first recess and an inner sidewall of the middle pole form a gap. The gap is typically sized and dimensioned to receive a burr of at least one of the inner pole and the middle pole. Thus, it should be appreciated that the gap allows the middle pole and inner pole to move relative to one another even when a burr has been created.

It is contemplated that the inner pole comprises a first flat sidewall portion, and the middle pole comprises a second flat sidewall portion. The first flat sidewall portion is typically adjacent to the second flat sidewall portion to thereby reduce rotation of the middle pole relative to the inner pole. Preferably, at least one aperture is disposed on each of the inner and middle pole in the first and second flat sidewall portions. The first and second flat sidewall portions typically have a greater thickness than the remaining portions of the middle and inner poles. Thus, bowing and burring are substantially reduced by (i) providing greater thickness where the apertures of the middle and inner poles are disposed, and (ii) preventing rotation of the middle and inner poles relative to one another.

Contemplated pole apparatus can further comprise an outer pole that at least partially houses the middle pole. The middle pole can comprise a flat sidewall portion that forms a gap with an inner surface of the outer pole. The gap is typically sized and dimensioned to receive a burr of at least one of the middle pole and the outer pole. Thus, it should be appreciated that the gap allows the middle pole and outer pole to move relative to one another even when a burr has been created.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The inventor has discovered that a pole apparatus can be designed to effectively reduce problems associated with conventional pole apparatus. More specifically, bowing and burring is reduced by at least one of (i) increasing the thickness in areas where apertures are disposed, and (ii) preventing rotation of the poles relative to one another. Additionally, a gap is provided between the poles that can receive burring and/or bowing. Advantageously, the telescopic function of the poles is not compromised by burring and/or bowing due to the clearance provided by the gap between the poles.

Figure 1:
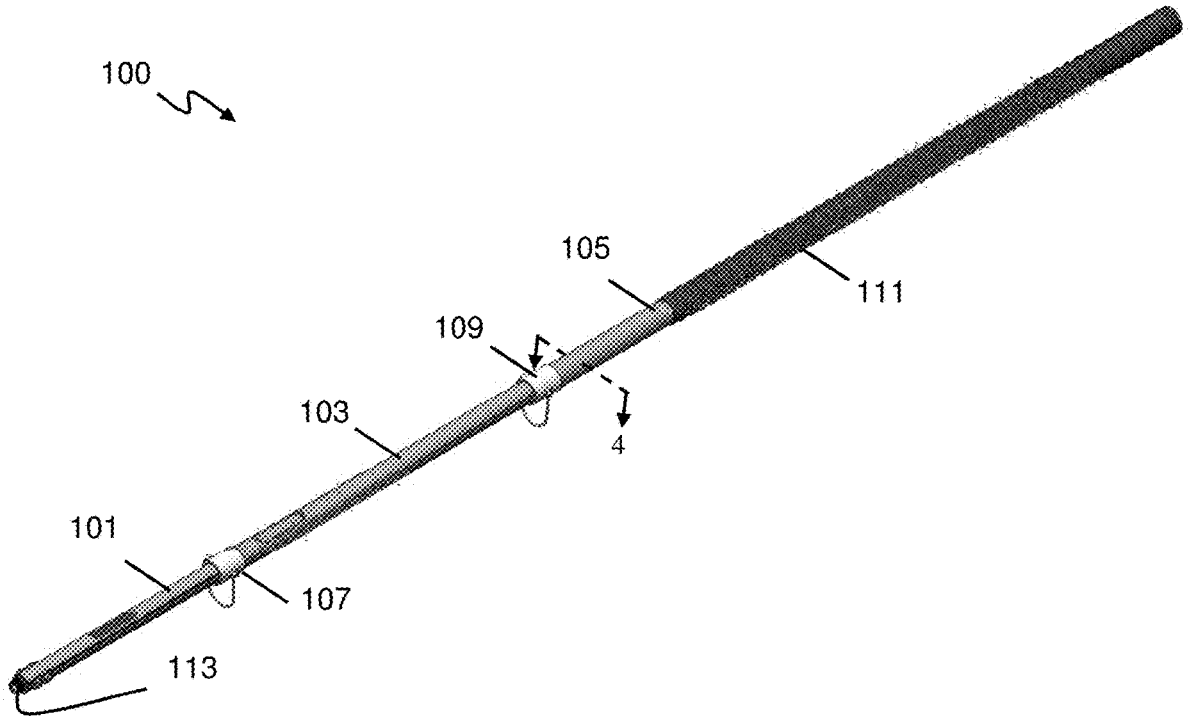
FIG. 1 is a perspective view of an embodiment of a pole apparatus.

FIG. 1 shows a pole apparatus 100 comprising an inner pole 101, a middle pole 103, and an outer pole 105. Inner pole 101 is at least partially disposed within middle pole 103. Preferably, inner pole 101 telescopically engages with middle pole 103 by use of a first coupler 107. In other words, inner pole 101 can slide in and out of middle pole 103 to increase or decrease the length of pole apparatus 100, and a position of inner pole 101 relative to middle pole 103 can be fixed by first coupler 107.

Middle pole 103 is at least partially disposed within outer pole 105. Similar to inner pole 101 and middle pole 103, it is contemplated that middle pole 103 telescopically engages with outer pole 105 by use of a second coupler 109. In other words, middle pole 103 can slide in and out of outer pole 105 to increase or decrease the length of pole apparatus 100, and a position of middle pole 103 relative to outer pole 105 can be fixed by second coupler 109. Thus, the length of pole apparatus 100 can be adjusted by the telescopic engagement between inner pole 101 and middle pole 103 and/or middle pole 103 and outer pole 105.

Inner pole 101, middle pole 103 and outer pole 105 can comprise the same material. For example, inner pole 101, middle pole 103, and outer pole can comprise a metal or metal alloy (e.g., tubular aluminum, aluminum-magnesium alloy). However, it is contemplated that inner pole 101, middle pole 103 and outer pole 105 can comprise other suitable materials. It is contemplated that inner pole 101, middle pole 103 and outer pole 105 can each have a length between 2 ft to 10 ft, and more preferably between 4 ft and 8 ft. In some embodiments, inner pole 101, middle pole 103 and outer pole 105 have the same length (e.g., 4 ft, 6 ft, 8 ft, etc.). In other embodiments, at least two of inner pole 101, middle pole 103 and outer pole 105 have different lengths.

Although pole apparatus 100 comprises three pole segments (inner pole 101, middle pole 103, and outer pole 105), it is contemplated that pole apparatus 100 can comprise two pole segments (e.g., two segments of inner pole 101, middle pole 103 and outer pole 105) or more than three segments. For example, pole apparatus 100 can comprise two pole segments that are each 4 ft, 6 ft, or 8 ft.

A grip 111 is disposed on an end of pole apparatus 100 that is proximal to a user. Grip 111 is preferably disposed on an outer surface of outer pole 105. Typically, grip 111 comprises a non-slip insulated rubber. A top cap 113 is disposed on another end of pole apparatus 100 that is distal to a user. Top cap 113 is configured to couple a variety of tools, including, but not limited to, the Ninja™ fastening tool, forced entry ceiling tool systems (e.g., Viper® (I, II, III, IV), Sniper®, Nitroset®, etc.), and other tool systems. For example, it is contemplated that top cap 113 comprises a threaded portion that is sized and dimensioned to couple with a threaded portion of the Ninja™ fastening tool. Additionally, or alternatively, it is contemplated that top cap 113 can couple another pole apparatus.

Figure 2:
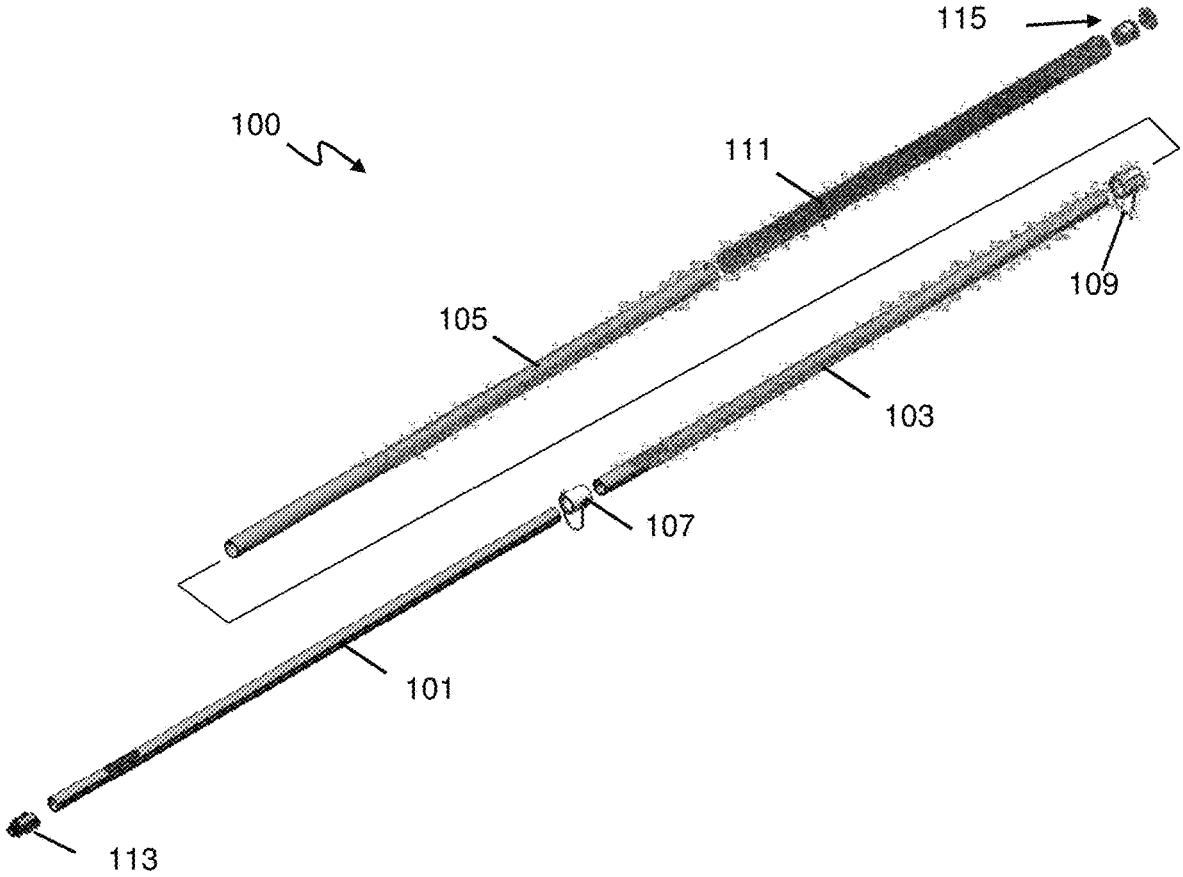
FIG. 2 is an exploded view of the pole apparatus of FIG. 1.
Figure 3:
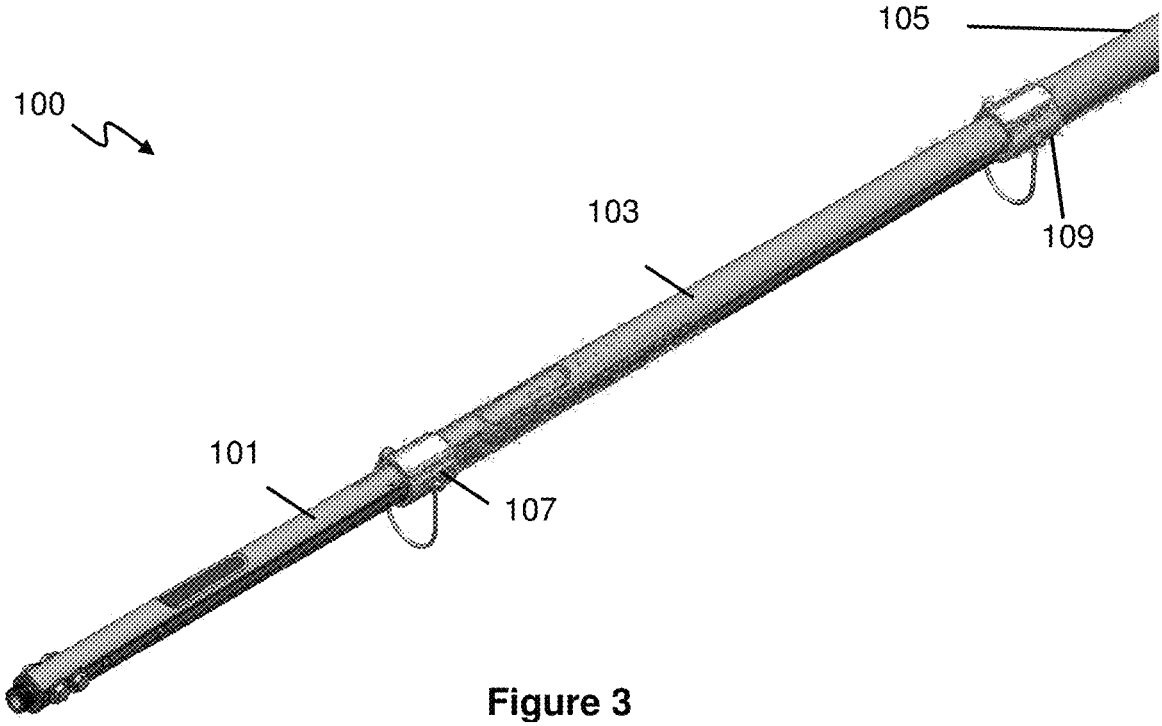
FIG. 3 is partial view of a distal portion of the pole apparatus of FIG. 1.

FIGS. 2 and 3 show other views of pole apparatus 100. As discussed above, inner pole 101 is at least partially disposed within middle pole 103, and middle pole 103 is at least partially disposed within outer pole 105. An end cap 115 can be disposed on an end of pole apparatus that is proximal to a user.

Figure 4:
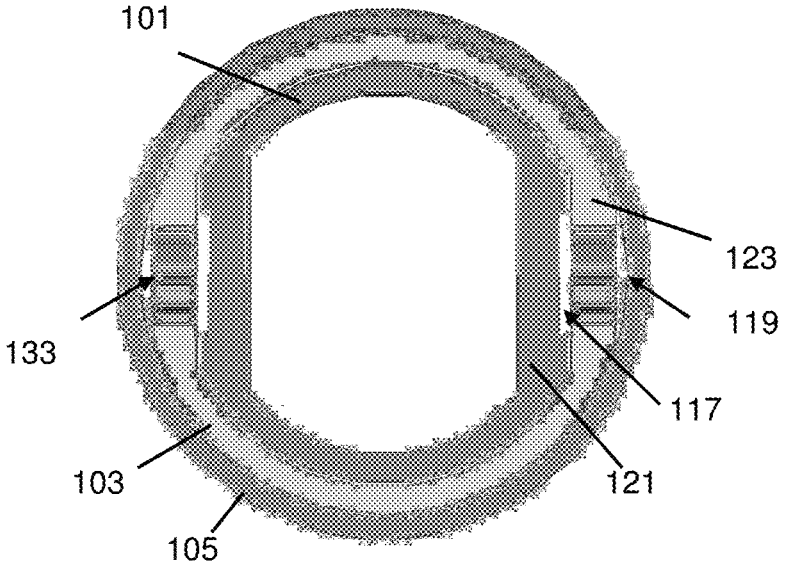
FIG. 4 is a cross-sectional view of the pole apparatus of FIG. 1.

FIG. 4 shows a cross-sectional view of pole apparatus 100 along line 4 in FIG. 1. Inner pole 101 is disposed within middle pole 103 and outer pole 105, and middle pole 103 is disposed within outer cover 105. Inner pole 101 comprises a first recess disposed on an outer sidewall. Preferably, the first recess is disposed on a first flat sidewall 121. The first recess of inner pole 101 and an inner sidewall of middle pole 103 form a gap 117.

It should be appreciated that gap 117 is sized and dimensioned to receive any burring and/or bowing that occurs on at least one of inner pole 101 and middle pole 103. For example, gap 117 can receive burring and/or bowing that occurs on apertures disposed along the first recess in first flat sidewall 121 or a second flat sidewall 123, such that inner pole 101 can telescopically slide relative to middle pole 103 without interference from the burred material. It is contemplated that inner pole 101 and middle pole 103 can form another gap that is also sized and dimensioned to receive burred material.

Similarly, a second gap 119 can be formed by second flat sidewall 123 of middle pole 103 and an inner surface of outer pole 105. Second gap 119 can be sized and dimensioned to receive any burring and/or bowing that occurs on at least one of middle pole 103 and outer pole 105. For example, gap 119 can receive burring and/or bowing that occurs on apertures disposed along second flat sidewall 123 and outer pole 105, such that middle pole 103 can telescopically slide relative to outer pole 105 without interference from burred material. It is contemplated that middle pole 103 and outer pole 105 can form another gap that is also sized and dimensioned to receive burred material.

Rotation of middle pole 103 with respect to inner pole 101 can be prevented to also reduce burring and/or bowing. As shown in FIG. 4, first flat sidewall 121 can be disposed adjacent to second flat sidewall 123 to thereby reduce rotation of middle pole 103 relative to inner pole 101. With respect to preventing rotation, it should be noted that the cross sectional shapes of the poles are configured to prevent rotation, which relieves rotational forces put on the pin and aperture during use, thereby reducing burring at the aperture compared to conventional pole devices (e.g., Ninja™ fastening tool by BluePoint® Fasteners).

Figure 5:
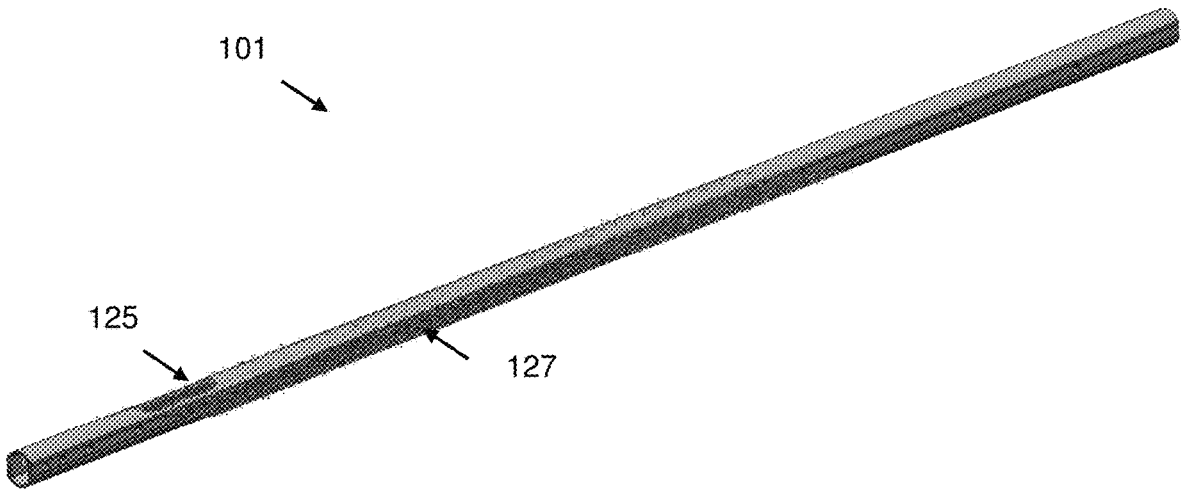
FIG. 5 is a perspective view of the inner pole of the pole apparatus of FIG. 1.

A perspective view of inner pole 101 is shown in FIG. 5. Inner pole 101 comprises an aperture 125 and a second aperture 127. Aperture 125 allows a user to access the interior of inner pole 101. It is contemplated that second aperture 127 is sized and dimensioned to receive a pin to couple inner pole 101 to at least one of middle pole 103 and outer pole 105. Preferably, multiple apertures are disposed along the length of inner pole 101 that are sized and dimensioned to receive a pin to provide multiple height options for pole apparatus 100.

Figure 6:
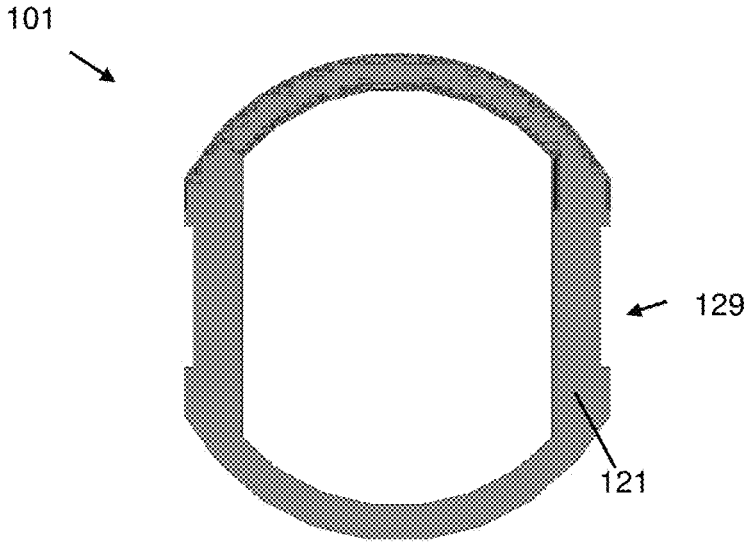
FIG. 6 is a cross-sectional view of the inner pole of FIG. 5.

As shown in FIG. 6, inner pole 101 has a substantially tubular shape. Inner pole 101 comprises first flat sidewall 121 and another flat sidewall on an opposing side of inner pole 101. A recess 129 is disposed on a sidewall of inner pole 101, and preferably, on first flat sidewall 121. In preferred embodiments, second aperture 127 and other apertures that can receive a pin are disposed on sidewall that is within recess 129 or the opposing recess.

Figure 7:
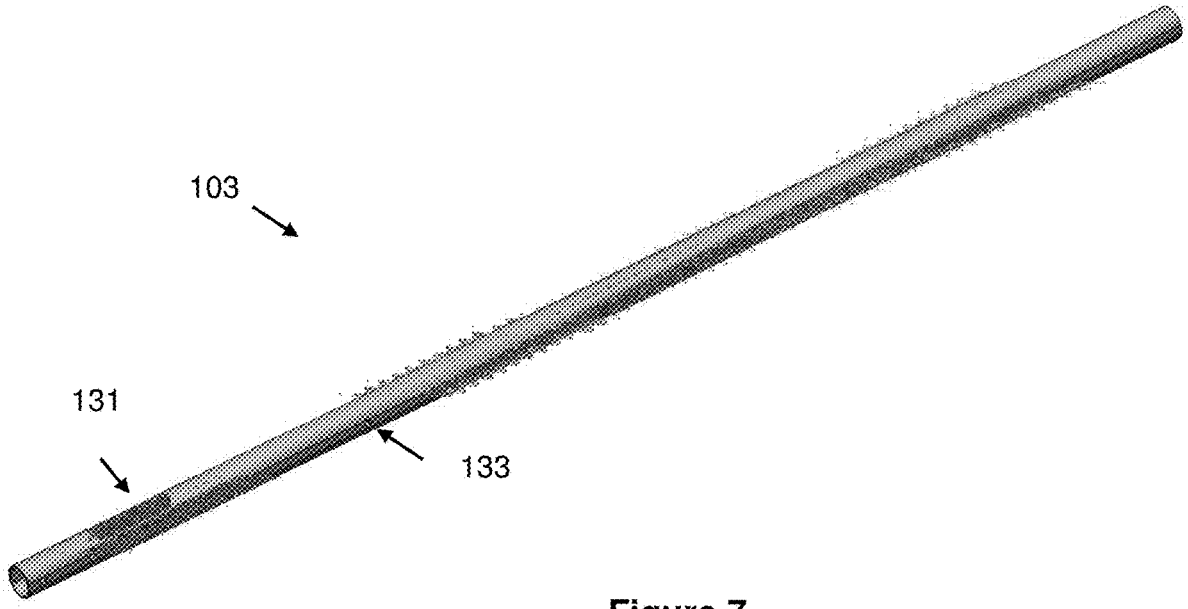
FIG. 7 is a perspective view of the middle pole of the pole apparatus of FIG. 1.

A perspective view of middle pole 103 is shown in FIG. 7. Middle pole 103 also comprises an aperture 131 and a second aperture 133. Aperture 131 allows a user to access the interior cavity of pole apparatus 100. It is contemplated that in some embodiments access to the interior cavity of pole apparatus 100 through aperture 131 is only allowed when aperture 131 is aligned with aperture 125 of inner pole 101. Second aperture 133 is typically sized and dimensioned to receive a pin to couple middle pole 103 to at least one of inner pole 101 and outer pole 105. It is contemplated that additional apertures are disposed along the length of middle pole 103 to provide multiple height options for pole apparatus 100.

Figure 8:
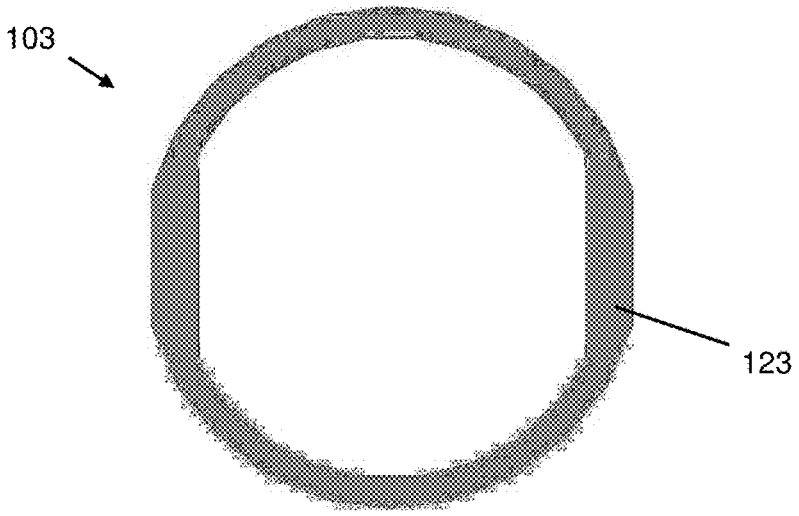
FIG. 8 is a cross-sectional view of the middle pole of FIG. 7.

A cross-sectional view of middle pole 103 is shown in FIG. 8. Middle pole comprises second flat sidewall 123 and another flat sidewall on an opposing side. Preferably, second aperture 133 and any other apertures that can receive pin are disposed on second flat sidewall 123 or the opposing flat sidewall.

Figure 9:
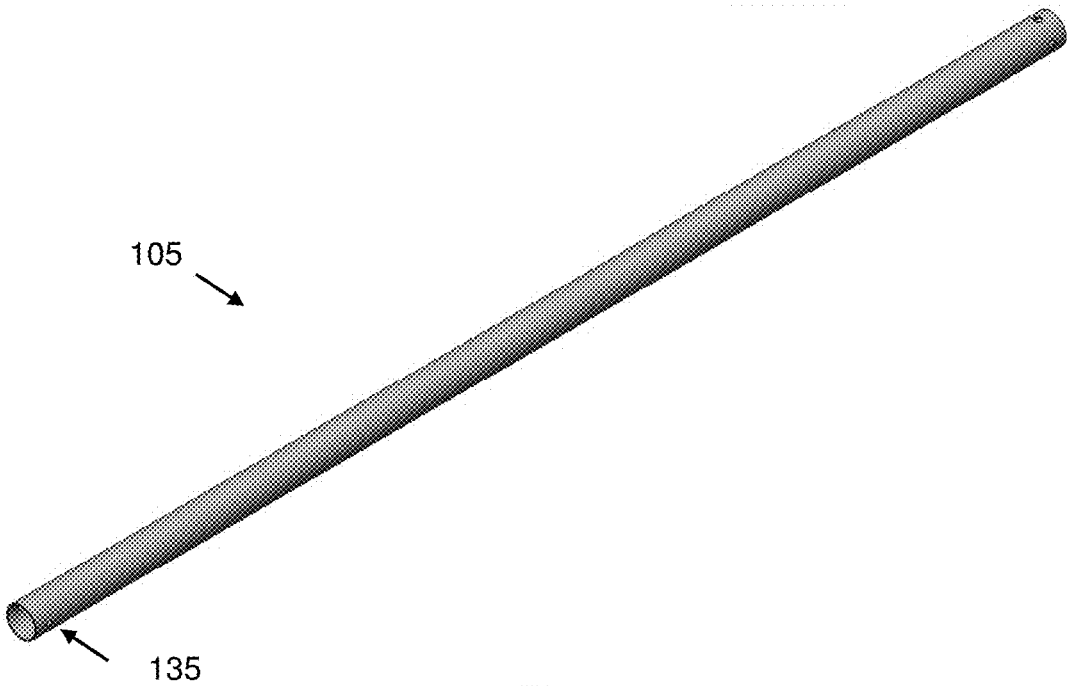
FIG. 9 is a perspective view of the outer pole of the pole apparatus of FIG. 1.
Figure 10:
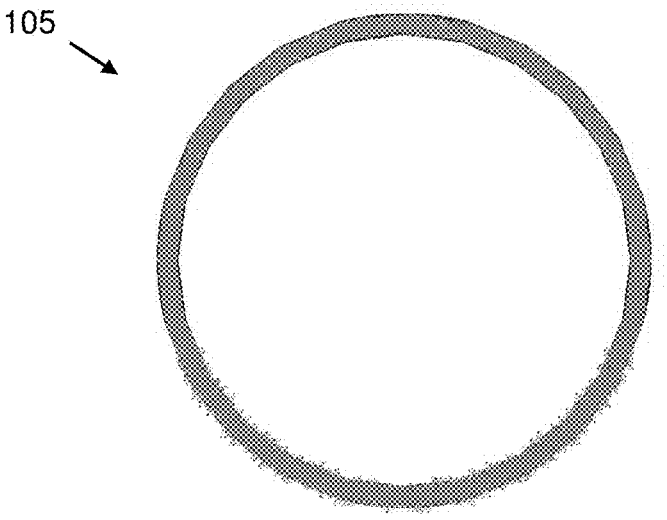
FIG. 10 is cross-sectional view of the outer pole of FIG. 9.

A perspective view of outer pole 105 is shown in FIG. 9. Outer pole comprises an aperture 135 disposed on one end of outer pole 105. It is contemplated that additional apertures are disposed on the same end of outer pole 105 and/or additional apertures are disposed on an opposite end of outer pole 105. It should be appreciated that aperture 135 is sized and dimensioned to receive a pin to couple outer pole 105 to at least one of inner pole 101 and middle pole 103. As shown in FIG. 10, the cross-section of outer pole 105 has a tubular shape. However, other shapes are contemplated.

Figure 11:
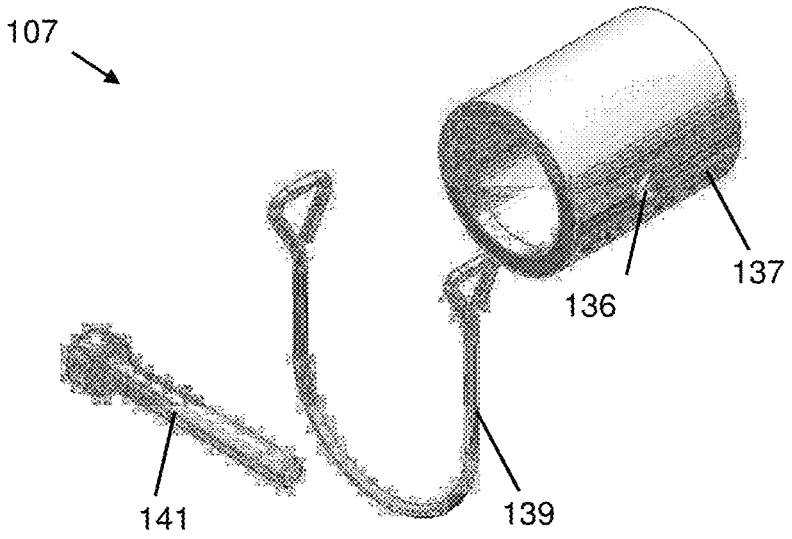
FIG. 11 shows an exploded view of the coupler of the pole apparatus of FIG. 1.

FIG. 11 shows an exploded view of the first coupler 107 comprising a sleeve 137, a clasp 139 and a pin 141. Sleeve 137 is disposed on the outer surface of pole apparatus 100 and comprises an aperture 136 sized and dimensioned to receive pin 141. In preferred embodiments, pin 141 is inserted through aperture 136 and through apertures of at least one of inner pole 101, middle pole 103 and outer pole 105 to couple the at least one of inner pole 101, middle pole 103 and outer pole 105 and maintain a fixed height of pole apparatus 100. To adjust the height of pole apparatus 100, a user can remove pin 141 and slide at least one of inner pole 101, middle pole 103 and outer pole 105 relative to one another, then re-insert pin 141 through aperture 136 and apertures of at least one of inner pole 101, middle pole 103 and outer pole 105. It is contemplated that clasp 139 can be used to secure pin 141 within apertures of sleeve 137 and at least one of inner pole 101, middle pole 103 and outer pole 105.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A pole apparatus, comprising:

a first pole;

a second pole at least partially disposed within the first pole, wherein the second pole comprises a first recess disposed on an outer sidewall;

wherein the first recess and an inner sidewall of the first pole form a gap between the first and second poles; and a second recess disposed on the outer sidewall of the second pole, and wherein the second recess and the inner sidewall of the first pole form a second gap between the first and second poles.

2. The pole apparatus of claim 1, wherein the gap is sized and dimensioned to receive a burr of at least one of the first and second poles.

3. The pole apparatus of claim 1, wherein the second gap is sized and dimensioned to receive a second burr of at least one of the first and second poles.

4. The pole apparatus of claim 1, wherein the first pole comprises a first flat sidewall portion, and wherein the second pole comprises a second flat sidewall portion, and wherein the first flat sidewall portion is adjacent to the second flat sidewall portion when the second pole is at least partially disposed within the first pole to thereby inhibit rotation of the first pole relative to the second pole.

5. The pole apparatus of claim 4, wherein the first recess is disposed on the first flat sidewall portion.

6. The pole apparatus of claim 1, further comprising an outer pole that at least partially houses the first pole.

7. The pole apparatus of claim 6, further comprising apertures disposed on each of the first, second, and outer poles, and wherein the apertures are sized and dimensioned to receive a pin to thereby couple the first, second, and outer poles.

8. A pole apparatus, comprising:

a first pole;

a second pole at least partially disposed within the first pole, wherein the second pole comprises a first recess disposed on an outer sidewall, and wherein the first recess and an inner sidewall of the first pole form a gap between the first and second poles;

an outer pole that at least partially houses the first pole; and wherein the second pole comprises a flat sidewall portion, and wherein the flat sidewall portion and an inner surface of the outer pole form a second gap between the second and outer poles.

9. The pole apparatus of claim 8, wherein the second gap is sized and dimensioned to receive a burr of at least one of the second pole and the outer pole.

10. A telescoping pole, comprising:

an inner segment having a first sidewall;

a middle segment having a second sidewall;

an outer segment, and wherein at least a portion of the middle segment is disposed within the outer segment;

wherein at least a portion of the inner segment is disposed within the middle segment, such that the inner segment can slide into or out from the middle segment and thereby extend a length of the pole;

wherein at least a portion of the first sidewall is flat, and wherein at least a portion of the second sidewall is flat, and wherein the first flat sidewall portion is adjacent to the second flat sidewall portion when the inner segment is at least partially disposed within the middle segment to help prevent rotation of the inner segment relative to the middle segment; and wherein the flat sidewall portion of the middle segment and an inner surface of the outer segment form a gap between the middle and outer segments.

11. The telescoping pole of claim 10, wherein the gap is sized and dimensioned to receive a burr of at least one of the middle and outer segments.

12. The telescoping pole of claim 10, further comprising apertures disposed on each of the inner, middle and outer segments, and wherein the apertures are sized and dimensioned to receive one or more pins to thereby couple the inner and middle segments and the middle and outer segments.

13. The telescoping pole of claim 10, wherein the inner segment comprises a first recess disposed on an outer sidewall of the inner segment, and wherein the first recess and an inner sidewall of the middle segment form a gap between the inner and middle segments.

14. The telescoping pole of claim 13, wherein the gap is sized and dimensioned to receive a burr of at least one of the inner and middle segments.

15. The telescoping pole of claim 13, wherein the first recess is disposed on the first flat sidewall portion of the inner segment.

16. A telescoping pole, comprising:

an inner segment having a first sidewall;

a middle segment having a second sidewall;

wherein at least a portion of the inner segment is disposed within the middle segment, such that the inner segment can slide into or out from the middle segment and thereby extend a length of the pole;

wherein at least a portion of the first sidewall is flat, and wherein at least a portion of the second sidewall is flat, and wherein the first flat sidewall portion is adjacent to the second flat sidewall portion when the inner segment is at least partially disposed within the middle segment to help prevent rotation of the inner segment relative to the middle segment;

wherein the inner segment comprises a first recess disposed on an outer sidewall of the inner segment, and wherein the first recess and an inner sidewall of the middle segment form a gap between the inner and middle segments; and a second recess disposed on the outer sidewall of the middle segment, and wherein the second recess and the inner sidewall of the inner segment form a second gap between the inner and middle segments.

17. The telescoping pole of claim 16, wherein the second gap is sized and dimensioned to receive a second burr of at least one of the inner and middle segments.

* * * * *